United States Patent [19]

Grant et al.

[11] Patent Number: 4,843,730

[45] Date of Patent: Jul. 4, 1989

[54] METHOD AND APPARATUS FOR DRYING ATHLETIC BALLS

[76] Inventors: Charles F. Grant, 27 Mallard La., Walpole, Mass. 02081; Gary S. Procaccini, 319 Washington St., E. Walpole, Mass. 02032

[21] Appl. No.: 109,210

[22] Filed: Oct. 15, 1987

[51] Int. Cl.[4] ..... F26B 3/00

[52] U.S. Cl. ..... 34/9; 34/95; 34/104; 34/202

[58] Field of Search ..... 34/104, 58, 95, 202, 34/9

[56] References Cited

U.S. PATENT DOCUMENTS 4,055,002 10/1977 Roberts ..... 34/104

4,321,756 3/1982 Mosely ..... 34/58

4,682,422 7/1987 Harris ..... 34/95

*Primary Examiner*—Henry A. Bennet

*Attorney, Agent, or Firm*—John P. McGonagle

[57] ABSTRACT

A method and dryer pack utilized therein for drying wet athletic balls such as footballs and baseballs between plays during an athletic or sporting event. The wet ball is placed into a dryer pack containing granular synthetic amorphous silicon dioxide, shaken and removed. The dryer pack is comprised of a shaker bag and a sealed envelope containing the silicon dioxide attached within the shaker bag. The envelope contains a tear string which when acted upon releases the silicon dioxide into the bag. The wet ball and silicon dioxide are shaken together thereby drying the ball.

5 Claims, 2 Drawing Sheets

METHOD AND APPARATUS FOR DRYING ATHLETIC BALLS

BACKGROUND OF THE INVENTION

This invention relates to drying, and in particular to a method and pack for drying wet athletic balls.

Outdoor sports which use balls, such as football and baseball are directly effected by weather conditions. While temperature and lighting conditions are important factors, probably the most significant factor is moisture. Whether moisture is from rain, snow or field conditions, the effect on ball handling is significant. A wet football is heavy and difficult to grasp and throw. Errant passes and fumbles are more common under wet conditions than dry conditions. A wet baseball is difficult to grasp and the consequent loss of control becomes especially dangerous to batters at higher levels of play. In both situations moisture tends to damage the ball and shorten its longevity.

SUMMARY OF THE INVENTION

The present invention is directed to a method of drying athletic balls, such as footballs and baseballs, between plays during an athletic or sporting event, and to a dryer pack utilized therein. The method involves placing a wet ball into a shaker bag containing granular silica gel, whereby moisture on the ball is quickly absorbed by the gel. The pack has a sealed envelope containing the silica gel, attached within the shaker bag. The envelope is airtight and moisture-proof. When the dryer pack is to be used, an opening means in the envelope is acted upon and the silica gel contained therein is released into the shaker bag.

Various advantages and features of novelty which characterize the invention are pointed out with particularity in the claims annexed hereto and forming a part hereof. However, for a better understanding of the invention, its advantages and objects obtained by its use, reference should be had to the drawings, which form a further part hereof, and to the accompanying descriptive matter, in which there is illustrated and described a preferred embodiment of the invention.

DETAILED DESCRIPTION OF THE INVENTION

Figure 2:
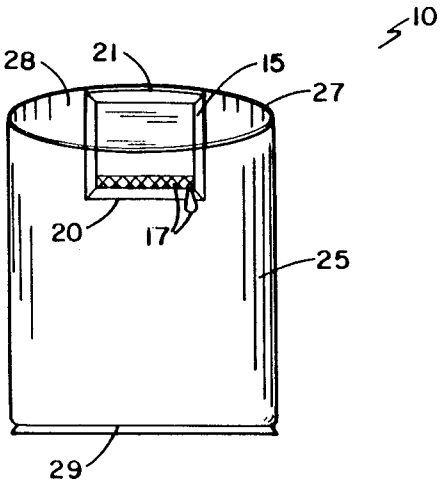
FIG. 2 illustrates the dryer pack of FIG. 1 assembled.
Figure 1:
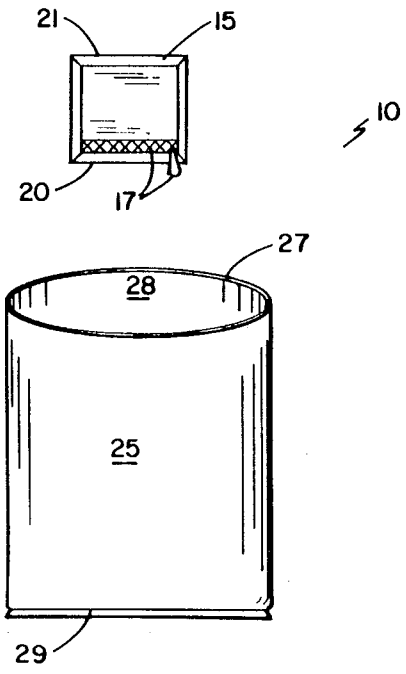
FIG. 1 is an exploded elevational view showing a sealed envelope containing the silica gel and a shaker bag that receives the sealed envelope in the present dryer pack.
Figure 3:
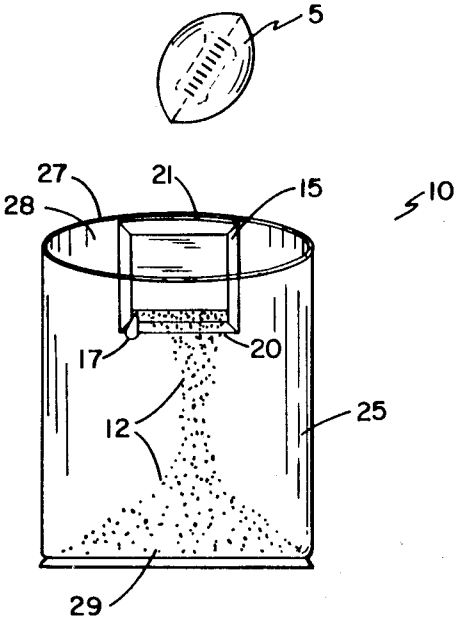
FIG. 3 illustrates the release of the silica gel from the sealed envelope in the dryer pack of FIG. 2 into the shaker bag and insertion of an athletic ball therein.

Referring to the drawings in detail, wherein like numerals indicate like elements, there is shown in FIGS. 1 and 2 a preferred embodiment of the dryer pack 10 used in the present invention. The dryer pack 10 has two main parts, a shaker bag 25 and a generally square-shaped, sealed envelope 15. The envelope 15 is relatively small, i.e., approximately ten inches square on one side, and is made of an airtight and moisture-proof material of suitable flexible plastic or foil. The envelope 15 contains within it approximately one and one-half pounds of fine-size (grade 11) granular silica gel 12. The gel 12 is comprised of synthetic amorphous silicon dioxide ($SiO_2$) and is not to be confused with crystalline silica such as quartz, cristobalite or tridymite or with diatomaceous earth or other naturally occurring forms of amorphous silica that frequently contain crystalline forms. The silica gel 12 has a pronounced drying action and absorbs any moisture it comes in contact with. The envelope 15 contains a tear string 17 along its bottom edge which when pulled releases the granular silica gel 12. See FIG. 3. The envelope 15 is attached to and within the shaker bag 25. The envelope's top edge 21 is fixedly attached along a lip 27 located at the opening 28 of the shaker bag 25. When releasing the silica gel 12 from the envelope 15, the shaker bag 25 is held lip 27 upward so that the gel 12 falls to the bottom 29 of the shaker bag 25. The shaker bag 25 when laid flat is generally rectangular approximately twenty inches along the lip 27 and having a depth of approximately twenty-four inches. The bag 25 may be made out of any flexible material. In the preferred embodiment a strong, clear, flexible plastic bag is used. Under the weather conditions in which this invention is most likely to be used, this choice of material will keep ambient moisture out of the bag 25. Using clear plastic will also permit the user to examine the contents of the bag 25 when in use as described below.

Figure 4:
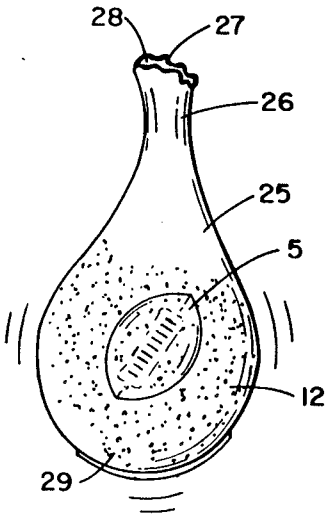
FIG. 4 illustrates the dryer pack of FIG. 3 in use.

In use, the dryer pack 10 is unfolded and positioned so that pulling the envelope's tear string 17 will cause the granular silica gel 12 to fall to the bottom 29 of the shaker bag 25. The wet athletic ball 5 to be dried is wiped off with a towel to remove excess surface moisture. This is more of a blotting action, as rubbing will force moisture into the leather used in making most athletic balls. The ball 5 is then placed into the shaker bag 25. As illustrated in FIG. 4, the shaker bag 25 is closed by grasping its neck 26 and the ball 5 is shaken within the bag 25 for ten to fifteen seconds making sure that the gel 12 covers the entire ball 5. When this step is completed, the bag 25 is opened. loose gel 12 is shaken off of the ball 5 and the ball 5 is removed from the bag 25. Any remaining gel 12 is wiped off of the ball 5 with a dry towel. The dried ball 5 is then ready to be returned to play.

Shaking the ball 5 within the bag 25 with gel 12 for as little as five seconds will usually be sufficient to fully dry the ball 5. However, shaking it longer will always dry the ball 5. Any wet mud and dirt on the ball 5 will also be dried and is removed with residual gel 12 when the ball 5 is wiped off with a dry towel. After the gel 12 is released from the envelope 15, the envelope 15 lies flat along the shaker bag 25 body and does not interfere with the drying operation.

Experimentation has shown that one envelope 15 of gel 12 will last for an entire baseball game. For a football game where two footballs are used, one of which is dried after every play, one envelope 15 of gel 12 is effective for one-half of a game.

It is understood that the above-described embodiment is merely illustrative of the application. Other embodiments may be readily devised by those skilled in the art which will embody the principles of the invention and fall within the spirit and scope thereof.

We claim:

1. A process for drying a wet athletic ball comprising the steps of:

wiping said ball with a towel to remove excess surface moisture;

placing dry, granular, fine-size, synthetic amorphous silica gel in a moisture impervious shaker bag;

placing said ball into said bag along with said gel;

closing said bag;

shaking the contents of said bag for at least five seconds making sure that the entire ball is covered with said gel;

opening said bag;

shaking loose gel off of the ball;

removing said ball from said bag; and wiping any remaining gel off of the ball with a dry towel.

2. The process of claim 1 wherein:

the contents of said bag are shaken for at least ten seconds.

3. The process of claim 2 wherein:

said bag is made of clear, flexible plastic.

4. The process of claim 3 wherein:

said gel is contained in a sealed envelope attached to and contained within said bag, said envelope having a tear string which when acted upon releases said gel into said bag.

5. The process of claim 4 wherein:

one and one-half pounds of said gel are contained in said envelope.

* * * * *